United States Patent [19]

Appelblatt

[11] 4,174,653

[45] Nov. 20, 1979

[54] ARMORED WHEELED VEHICLE WITH DISPLACEABLE WHEEL WELL FAIRING PANELS

[75] Inventor: Irving Appelblatt, West Bloomfield, Mich.

[73] Assignee: Cadillac Cage Company, Warren, Mich.

[21] Appl. No.: 842,216

[22] Filed: Oct. 14, 1977

[51] Int. Cl.[2] ..... F41H 7/02

[52] U.S. Cl. ..... 89/36 H; 280/154.5 R

[58] Field of Search ..... D12/12; 89/36 H, 40 R, 89/40 A, 40 B, 40 C; 280/152 R, 153 R, 154.5 R

[56] References Cited

U.S. PATENT DOCUMENTS

| | | | |
|---|---|---|---|
| D. 193,771 | 10/1962 | Bauer | D12/12 |
| 2,311,941 | 2/1943 | Gustafson | 280/154.5 R |
| 3,876,229 | 4/1975 | Kohn et al. | 280/152 R |

*Primary Examiner*—Stephen C. Bentley

*Attorney, Agent, or Firm*—Krass & Young

[57] ABSTRACT

An armored wheeled vehicle is disclosed in which the front wheels are disposed within recessed wheel wells formed in the vehicle hull. The wheel wells are covered by means of spring biased fairing panels, disclosed by plates which are pivotally mounted on the sloping armored front deck of the vehicle hull and biased to a down position extending across the wheel well at the same angle of inclination as the deck surface to afford minimum vulnerability to weapons fire directed at the front area of the vehicle. The pivotal mounting accommodates the excursions of the front wheels created by suspension displacement on a bumpy road surface or cross country terrain contours by the tire contacting the fairing panels and forcing them open against the bias of the springs and being prepositioned upon movement of the wheel back within the wheel well to again present a minimum frontal area, disposed at the same inclination as the hull deck.

6 Claims, 4 Drawing Figures

Fig-1
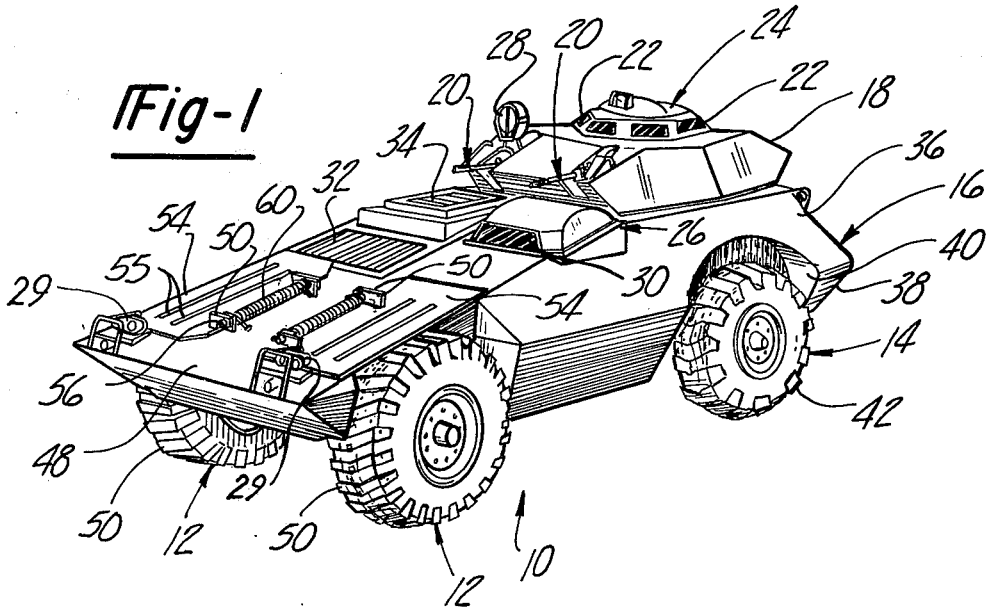
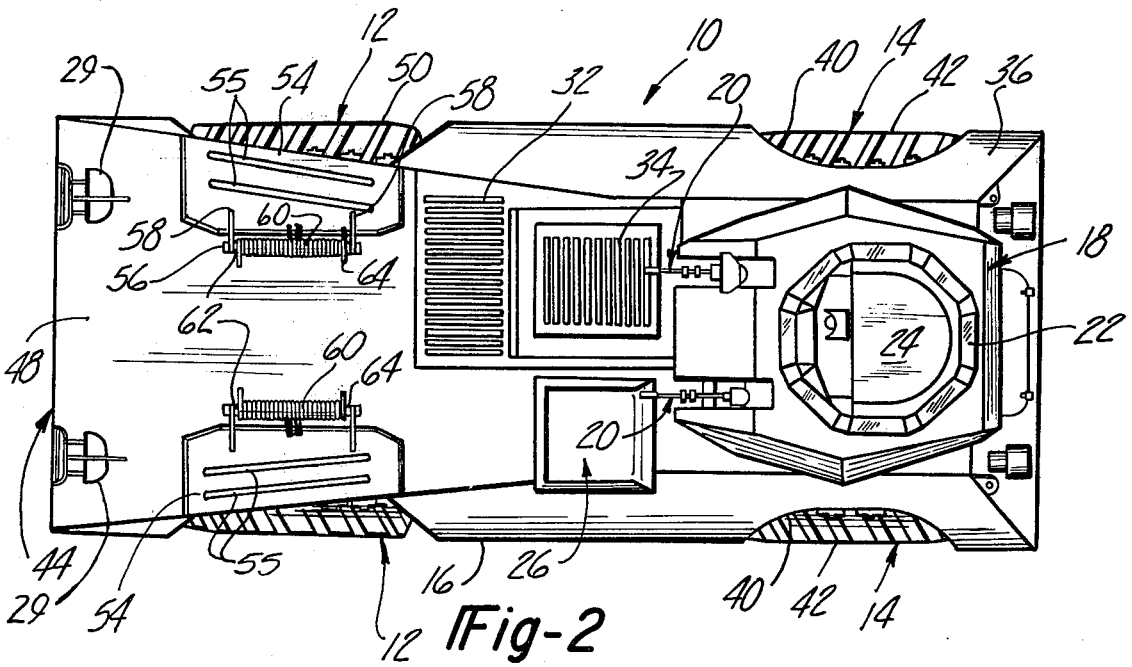
Fig-2

ARMORED WHEELED VEHICLE WITH DISPLACEABLE WHEEL WELL FAIRING PANELS

BACKGROUND OF THE INVENTION

1. Field of the Invention

This invention concerns armored vehicles and more particularly concerns wheeled armored vehicles such as armored cars, etc.

2. Description of the Prior Art

In the design of armored vehicles such as armored cars, it is of course of paramount importance to minimize the vulnerability of the exterior of the vehicle to weapons fire and particularly to ballistic impact. Such vulnerability is considerably reduced by the inclination of the exterior surfaces to the direction from which the fire is presumed to be directed. Most armored vehicles are designed for minimum vulnerability in the frontal direction since such vehicles are normally used in offensive or reconnaissance operations, so that tanks, personnel carriers, armored cars usually have armored structures on the frontal areas which are sharply inclined rearwardly to cause the impacting fire to be deflected away from the vehicle and also to maximize the thickness of the armor plate presented which must be penetrated by the ballistic impact. Any surfaces or contours existing which present a more obtuse inclination to the path of such ballistic projectiles of course are correspondingly more vulnerable. In addition, they have a tendency to increase the vulnerability of the vehicle hull itself since ballistic projectiles have a tendency to be turned inwardly and deflected into the hull by such localized contours or surfaces to partially defeat the effectiveness of the inclined armor plate. Naturally, such surfaces located in the frontal area of the vehicle offer much more serious disadvantage since minimum frontal vulnerability is a paramount design factor as described above. Such localized surface contours are oftentimes presented by appendages or vehicle accessories.

In the case of a wheeled vehicle, the vulnerability of the vehicle tires and wheels has presented a difficult design problem. If the wheels are left exposed by being located exterior of the vehicle hull, this results in a situation of extreme vulnerability of these components which can in effect disable the vehicle. If recessed within the vehicle hull and wheel wells, considerable clearance is required for accommodating the vertical travel of the wheel in a suspension system, particularly for cross country vehicles. This either necessitates a hull structure of sufficient depth to accommodate the wheel travel which increase in frontal area would of course greatly increase vulnerability of the vehicle. Alternatively, the design could provide a fender structure which extends above the surface of the hull front deck, but such a fender structure of course of necessity presents the vulnerable exterior obtuse contour in an area of maximum vulnerability, i.e., the front of the vehicle. These fenders also tend to obstruct the vision of the driver.

Elimination of the fender would create bluntly extending recesses constituted by the wheel well and would also lead to the accumulation of mud thrown up by the wheels tending to block the vision blocks, air intake and interfere with the various items of equipment, such as the weaponry, located so as to be subject to mud splatter.

It is, accordingly, an object of the present invention to provide an arrangement for enclosing the wheels of an armored vehicle in which the front wheels are supported on a suspension system to reduce their vulnerability to weapons fire directed at the frontal area of the vehicle.

It is another object of the present invention to provide an enclosure arrangement which does not involve the use of fender or fairing structures which constitute a discontinuity in the hull front decking armor contours or which present obtusely inclined surfaces and which create visual obstruction to the driver.

It is yet another object of the present invention to provide such an enclosure arrangement for the front wheels of the armored vehicle which does not create a mud splash problem and which substantially encloses the vehicle front wheels.

SUMMARY OF THE INVENTION

These and other objects, which will become apparent upon a reading of the following specification and claims, are accomplished by a mounting arrangement in which the front wheels are recessed within the vehicle hull into open ended wheel wells. The recesses are covered by means of pivotally mounted fairing panels such as flat armor plates which are spring biased in a downward position to cover the wheel wells and present a surface contour sloping at the same inclination as the hull upper deck in the region of the wheel well recesses. A relatively limited clearance is provided between the fairing panels and the front tires to minimize the projected frontal areas of the vehicle hull in the regions of the wheel wells, with the vertical travel of the wheels experienced during negotiations of rough terraine accommodated by the pivotal mounting of the fairing panels which are adapted to be engaged by the tires during vertical excursion and displace the fairing panels upwardly against the downward bias applied by the spring.

The wheel wells are thus completely enclosed by the front wheels while presenting an outer contour of minimum vulnerability to weapons fire directed at the front area of the vehicle.

DESCRIPTION OF THE DRAWINGS

FIG. 1 is a perspective view of an armored wheeled vehicle incorporating a front wheel mounting arrangement according to the present invention.

FIG. 2 is a plan view of the armored vehicle shown in FIG. 1.

DETAILED DESCRIPTION

Figure 3:
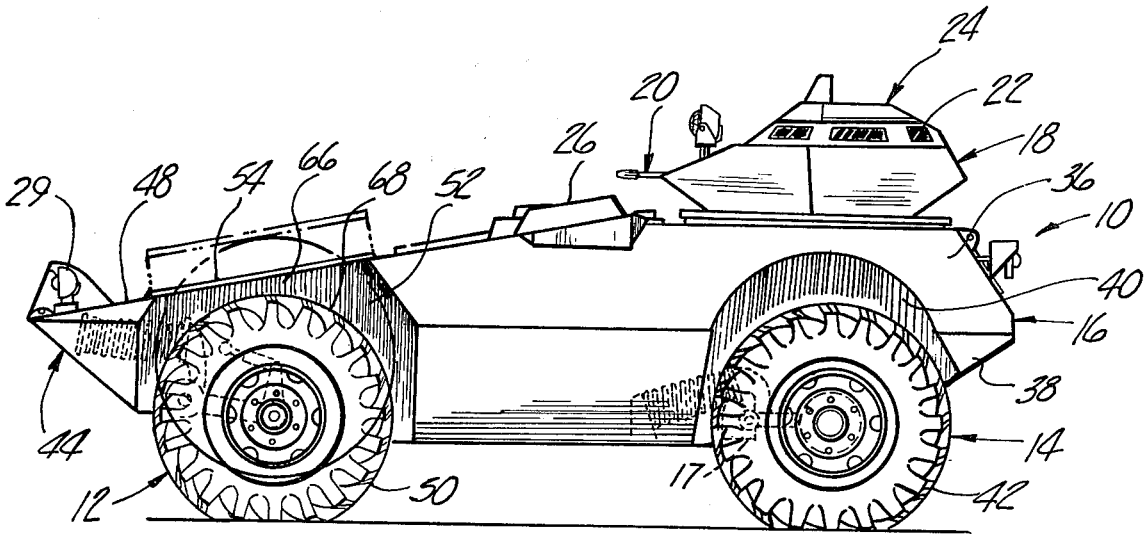
FIG. 3 is a side elevational view of the vehicle shown in FIGS. 1 and 2.

In the following detailed description, specific terminology will be utilized for the sake of clarity and a specific embodiment described in accordance with the requirements of 35 USC 112, but it is to be understood that the same is not intended to be limiting and indeed should not be so construed since the invention is capable of taking many forms within the scope of the appended claims.

Referring to the drawings, and particularly FIG. 1, the armored vehicle 10 shown is a wheeled armored vehicle of the type used for light reconnaissance missions in military operations or in police actions against terrorists or snipers or in civil disturbances in which the antagonists are not equipped with heavy weaponry. For this reason, the vehicle is generally lightly armored to resist ballistic impact from small arms fire to thus afford protection against such small arms fire.

The armored vehicle 10 shown is a wheeled vehicle having front wheels 12 and rear wheels 14 mounted to the vehicle hull 16 by means of a suspension system indicated as trailing arm suspension 17, which is described in detail in copending application Ser. No. 842,213, filed Oct. 14, 1977, attorney docket No. XLO-127. Such armored vehicle is normally constructed with a unitary hull 16 which is typically in such vehicles formed from a welded aluminum armor steel plate.

A rotatable turret 18 is often included which is mounted within the upper portion of the hull 16 and which typically is provided with armament, shown as machine guns 20 fired by a gunner viewing through vision blocks 22 formed in a cupola portion 24 of the turret 18. The driver compartment is enclosed with the cover 26 and a vision block 30 similarly provides vision for the driver. Illumination for night-time operation is provided by a spotlight 28 and headlights 29.

Ventilation and engine air intake grids 32 are provided, as well as exhaust grids 34.

It can be seen that the grids 32 and 34, the armament comprised of the machine guns 20, vision blocks 30 and 22, as well as the spotlight 28, are all in a position to be splattered with mud if the front wheels 12 were to be unshielded potentially creating operation difficulties as a result.

The hull structure 16 provided with sloping side surfaces 36 and 38 reduces vulnerability to flanking fire directed against the vehicle side. The rear wheels 14 are disposed within enclosing recesses or wheel wells 40 formed in the hull 16. The rear wheel wells 40 are adapted to enclose the upper region of the tires 42 since the hull depth at this point along the length of the armored car is adequate to accommodate the rear wheel well 40 configuration of sufficient depth to accommodate the full extent of lineal vertical travel of the rear wheels 14 on the rear suspension system.

The front portion 44 of the hull 16, on the other hand, is configured with a sloping front deck surface 48 which is inclined at a very oblique angle to the horizontal such that the depth of the hull in the region of the front wheels 12 is considerably narrower than at the rear wheels 14. Thus, to accommodate the full travel of the front wheels 12 and also to enclose the upper region of the tires 50, a fender or cowling structure as per conventional practice would of necessity extend above the lever of the inclined front deck 48 leading to the aforementioned vulnerability to frontally directed weapons fire as discussed above.

According to the concept of the present invention, the recesses into the hull 16 are provided which form front wheel wells 52 within which the front wheels 12 are located which are open at the upper region. The suspension system mounts the front wheels 12 within the wheel wells so as to be below the level of the front deck surface 48.

Figure 4:
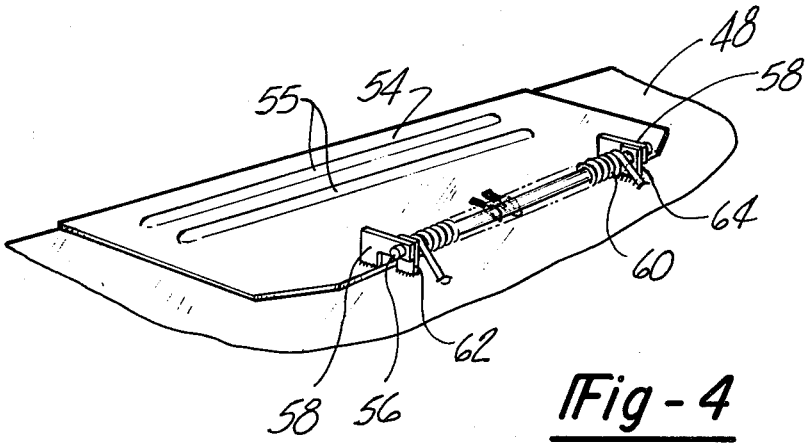
FIG. 4 is an enlarged plan view of the pivotal mounting arrangement of one of the fairing panels.

The open areas are overlain with a pair of fairing panels 54, shown as flat plates reinforced with stiffener ribs 55. The fairing panels 54 are pivotally mounted to the hull 16 by means of pivot bar 56 and lugs 58 welded to the fairing panels 54. Each of the fairing panels 54 is urged or biased to the position shown in FIGS. 1 and 2, that is, lying flat against the front deck 48, but by means of a pair of torsional wind-up springs 60 carried by the pivot bars 56 and having extension portions 62 and 64 engaging the fairing panel 54 and an upper surface of the front deck 48 respectively (FIG. 4) so as to resist pivotal movement about the pivot bars 56 and urging the same to the overlaying position shown.

Thus, the fairing panels 54 normally lie parallel to the frontal deck 48 such that an overall obliquely inclined and relatively smoothly contoured front deck is presented. The fairing panels 54 preferably are formed of the same armor material as the front deck 48, i.e., ballistic steel. The enclosing of the front wheels 12 is accomplished without increasing the vulnerability of the frontal area of the vehicle 10 to weapons fire directed against it. The pivotal mounting, on the other hand, allows the accommodation of extended front wheel 12 travel even though a relatively small clearance 66 is provided between the under surface of the fender plate and the upper surface of the tire 50 as shown in FIG. 3.

Hence, upon traversing an obstacle at sufficient speed or of sufficient height that the clearance 66 would be exceeded, the upper surface 68 of the front tires 50 engages the underside of the fairing panel 54 and rotates the fairing panels 54 about the pivot bar 56 to allow the front wheels 12 to travel above the plane of the upper deck 48. The jarring of the fairing panels 54 produced by the impact of the front tires 50 and their closure under the influence of the wind-up spring 60 keeps the front wheel well 52 relatively free of mud accumulation.

In addition, since the clearance space 66 accommodates normal wheel travel except under very rough conditions such as off-road travel and obstacles of relatively great height which are infrequently encountered, the front wheels 12 remain enclosed and majority of the time and even when partially opened, some mud shielding effect is still provided such that the upper areas of the vehicle described above are protected from mud which would otherwise be thrown up by the front tires 50.

It can thus be appreciated that the objects of the above-described invention have been accomplished by this enclosure arrangement for the front wheels 12 since the wheels are substantially enclosed so as to be protected from weapons fire in a frontal direction and to minimize the vulnerability of the tires 50 themselves and also to prevent the throwing of mud onto the upper regions of the armored car 10.

This has been accomplished without the necessity of increasing the depth of the vehicle hull 16 in the region of the front wheel 12 and without the creation of protuberances which compromise the oblique nature of the sloping front deck 48 to prevent the creation of vulnerable points in the frontal area of the armored car 10. The structure of mounting the fender panel 54 is relatively simple and trouble-free and in keeping with the ruggedness with which some ordnance equipment is designed to the severe operational environments normally encountered by such equipment.

Accordingly, an armored car in configuration has been provided in which vulnerability of the frontal area of the vehicle to frontally directed weapons fire is minimized without the penalty of creating operational difficulties such as caused by excessive mud splatter.

The configuration of the fairing panels 54 as well as the specifics of the mounting arrangement are, of course, exemplary since these may be varied within the scope of the appended claims such as alternative bar and pivot spring arrangements.

The embodiments of the invention in which an exclusive property or privilege is claimed are defined as follows:

1. A wheeled armored vehicle including:

an armored hull having an obliquely extending frontal deck structure of ballistic impact resisting material;

a plurality of wheels supporting said armored hull including two front wheel assemblies disposed on either side of said frontal deck;

a suspension system allowing relative travel of said wheel assemblies with respect to said armored hull;

an enclosure arrangement for said front wheels comprising recesses extending into said vehicle hull and onto the surface defined by said frontal deck, said suspension normally disposing said front wheels in said recess below the level of said frontal deck;

fairing panels overlaying said open recess and generally conforming to the shape of said frontal deck;

and means mounting said fairing panel to said hull allowing relative displacement therebetween so as to accommodate front wheel travel in said recesses above the level of said frontal deck whereby contours of said frontal deck are uninterrupted with structure enclosing said wheel wells extending above the level of said frontal deck while accommodating said wheel travel above the level of said frontal deck.

2. The wheeled armored vehicle according to claim 1 wherein said means mounting said fairing panels to said hull comprises means allowing pivotal movement of said fairing panels away from said recesses along an axis parallel to said front wheels.

3. The wheeled armored vehicle according to claim 1 wherein said frontal deck is substantially flat and said fairing panels are flat and said means mounting said fairing panels disposes said fairing panels at the same inclination as said frontal deck when overlaying said hull recesses, whereby no significant discontinuities with respect to said frontal deck are presented by said fairing panels.

4. The wheeled armored vehicle according to claim 1 further including the bias means exerting a bias force on each of said fairing panels tending to maintain said fairing panels in position over said hull recesses.

5. The wheeled armored vehicle according to claim 2 further including bias means exerting a bias force on each of said fairing panels tending to maintain said fairing panels in position over said hull recesses.

6. The wheeled armored vehicle according to claim 5 wherein said bias means includes springs drivingly engaging said fairing panels and resiliently resisting movement of said fairing panels away from said recess.

* * * * *